US007014128B2

(12) United States Patent
Leung

(10) Patent No.: US 7,014,128 B2
(45) Date of Patent: Mar. 21, 2006

(54) SHOWERHEAD ASSEMBLY

(75) Inventor: Anthony Kit Lun Leung, North Point (HK)

(73) Assignee: Conair Corporation, Stamford, CT (US)

( * ) Notice: Subject to any disclaimer, the term of this patent is extended or adjusted under 35 U.S.C. 154(b) by 148 days.

(21) Appl. No.: 10/673,082

(22) Filed: Sep. 26, 2003

(65) Prior Publication Data

US 2004/0124281 A1 Jul. 1, 2004

Related U.S. Application Data

(60) Provisional application No. 60/414,878, filed on Oct. 1, 2002, provisional application No. 60/467,089, filed on May 1, 2003.

(51) Int. Cl.
*B05B 1/26* (2006.01)

(52) U.S. Cl. ..... 239/461; 239/598; 239/242; 239/752; 239/282; 239/449; 239/553.3

(58) Field of Classification Search ..... 239/598, 239/461, 242, 752, 282, 449, 553.3
See application file for complete search history.

(56) References Cited

U.S. PATENT DOCUMENTS

| | | | | |
|---|---|---|---|---|
| 2,612,876 | A * | 10/1952 | Mahon | 239/752 |
| 3,724,760 | A | 4/1973 | Smith | |
| 3,858,252 | A | 1/1975 | Ejchorszt | |
| 4,008,503 | A | 2/1977 | Tharp | |
| 4,171,094 | A | 10/1979 | Halfen | |
| 4,274,400 | A | 6/1981 | Baus | |
| 4,282,612 | A | 8/1981 | King | |
| 4,340,177 | A | 7/1982 | Huber | |
| 4,809,369 | A | 3/1989 | Bowden | |
| 4,944,457 | A | 7/1990 | Brewer | |
| 5,035,010 | A | 7/1991 | Sakamoto et al. | |
| 5,205,490 | A | 4/1993 | Steinhardt et al. | |
| 5,299,743 | A | 4/1994 | Sieth et al. | |
| 5,321,860 | A | 6/1994 | Steinhardt et al. | |
| 5,628,458 | A * | 5/1997 | Kuo | 239/242 |
| 5,662,270 | A | 9/1997 | Scarano | |
| 5,675,846 | A | 10/1997 | Kannenberg | |
| 5,704,547 | A | 1/1998 | Golan et al. | |
| 5,816,500 | A | 10/1998 | Scarano | |
| 5,938,122 | A * | 8/1999 | Heren et al. | 239/242 |
| 6,148,453 | A | 11/2000 | Sartor | |
| 6,460,203 | B1 | 10/2002 | De Simone | |
| 2002/0144341 | A1 | 10/2002 | Zieger | |

FOREIGN PATENT DOCUMENTS

| | | |
|---|---|---|
| EP | 0 056 647 | 7/1982 |
| EP | 0 723 814 A2 | 7/1996 |

* cited by examiner

*Primary Examiner*—David A. Scherbel
*Assistant Examiner*—James S. Hogan
(74) *Attorney, Agent, or Firm*—Lawrence Cruz; Steven A. Garner

(57) ABSTRACT

A showerhead assembly has a tubular shaped spray head and a longitudinal axis. The tubular shaped spray head has several apertures located along the longitudinal axis. The tubular shaped spray head is connected to a water source for introducing water in the tubular shaped spray head. The showerhead assembly also has a housing for supporting the tubular shaped spray head on a surface. Water traverses through the tubular shaped spray head for spraying beams of water through the apertures.

18 Claims, 17 Drawing Sheets

SHOWERHEAD ASSEMBLY

CROSS-REFERENCE TO RELATED APPLICATIONS

This application claims priority to U.S. Provisional Patent Application Ser. No. 60/414,878 filed on Oct. 1, 2002 and claims priority to U.S. Provisional Patent Application Ser. No. 60/467,089 filed on May 1, 2003.

BACKGROUND OF THE INVENTION

1. Field of the Invention

The present invention relates to a showerhead. More particularly, the present invention relates to a wall-mounted showerhead having a rotating portion that is powered by water pressure. Still more particularly, the showerhead may have an alternative use mode that enables a user to switch and use a second showerhead.

2. Description of the Related Art

Showerheads are known in the art. They are available in a large variety of designs for a number of modes of operation such as handheld use or mounting in or on a shower wall. Showerheads may have one or more pulsating or variable pattern spray adjustments to provide massaging benefits while bathing. These types of showerheads are usually dedicated heads, or showerheads that are fixedly connected to a shower stall. These types of showerheads are usually cylindrical in shape and have apertures in a circular manner around a circumference of the dedicated showerhead. These dedicated heads are labor intensive especially during installation. Thus, they may deter customers from purchasing these dedicated heads because of the work associated with the installation, dismantling, and disabling a permanently installed showerhead. Also, these dedicated heads, while providing pulsating or massage action, have a limited range of motion, and usually one spray path.

Accordingly, there is a need from a showerhead that eliminates one or more of the aforementioned drawbacks and deficiencies of the prior art.

SUMMARY OF THE INVENTION

It is an object of the present invention to provide a showerhead assembly that has two or more modes.

It is another object of the present invention to provide a showerhead assembly with a first mode with an adjustable, rotating spray pattern.

It is another object of the present invention to provide a showerhead assembly with a second mode where the showerhead assembly is deactivated and permits usage of bathing with a second showerhead.

It is another object of the present invention to provide a showerhead assembly with a spray head pivotally mounted in the housing to pivot along an arcuate path to spray water in a predetermined pattern.

It is still another object of the present invention to provide a showerhead assembly with a tubular shaped spray head that has a pivoting motion powered by water flowing through the showerhead assembly.

It is a further object of the present invention to provide a showerhead assembly that has a control knob to selectively activate or deactivate the showerhead assembly.

It is a further object of the present invention to provide a showerhead assembly with a deactivated mode where a valve redirects water around the showerhead assembly to bypass the spray head, thereby diverting water flow to a second showerhead that is permanently installed in the showerhead assembly.

The above and other objects, advantages and benefits of the present invention will be understood by reference to the detailed description provided below and the accompanying drawings.

DETAILED DESCRIPTION OF THE INVENTION

Figure 1:
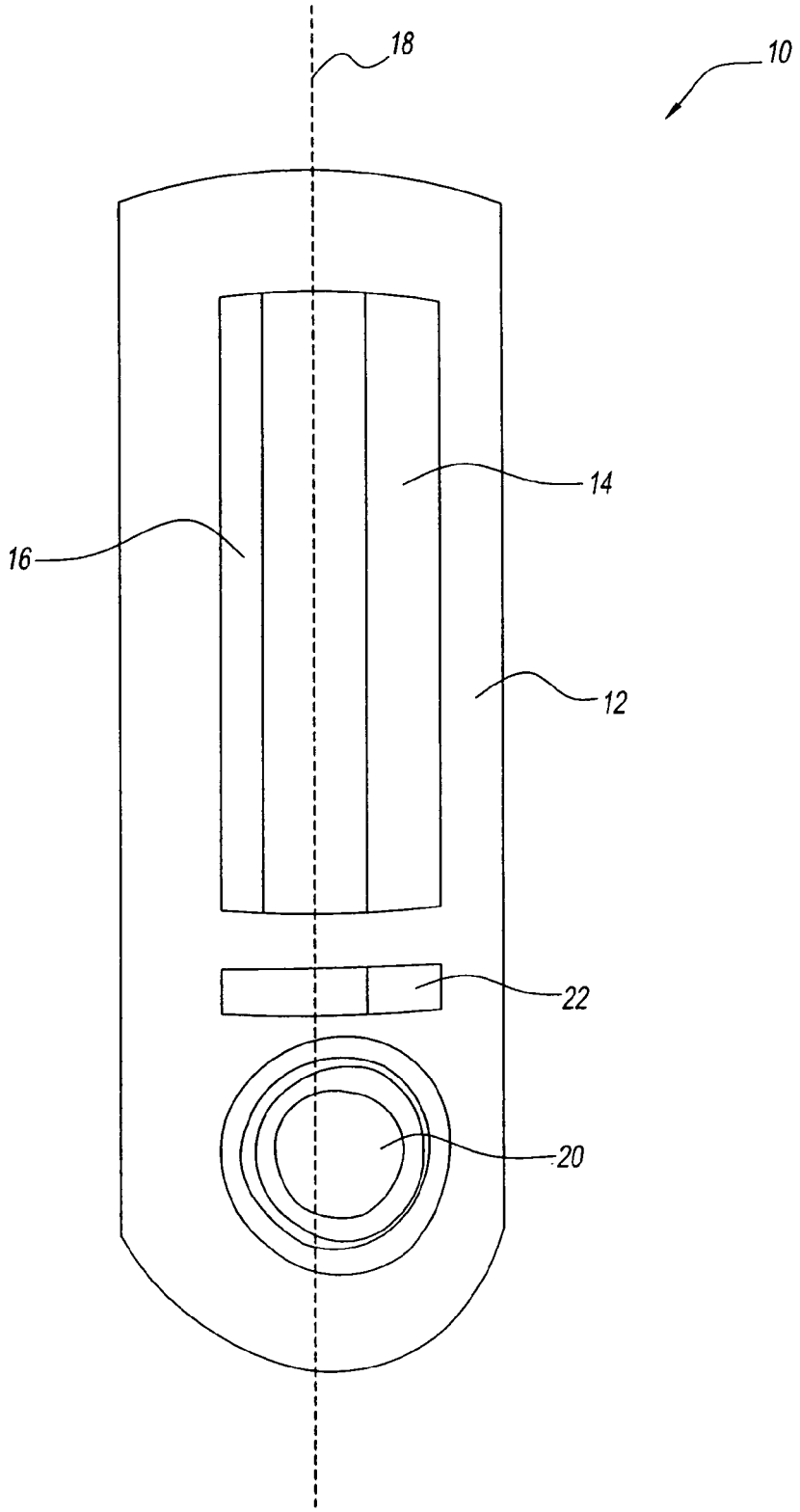
FIG. 1 is a front view of a preferred embodiment of the showerhead assembly according to the present invention.

Referring to the drawings and, in particular, FIG. 1, there is provided a showerhead assembly of the present invention being generally represented by reference numeral 10. The shower assembly 10 has a housing 12, preferably of a generally elongated orthogonal shape, for supporting the showerhead assembly on a surface such as, for example, a shower or bathtub.

The housing 12 preferably has a rectangular shaped aperture 14 disposed therethrough. The aperture 14 is sufficiently sized to allow water to be sprayed through the housing 12 on a bather. One skilled in the art should appreciate that the housing 12 or the aperture 14 may be any shape known in the art to accommodate a particular spray pattern or any potential mounting constraints of a particular shower.

The showerhead assembly 10 has a spray head 16 in the aperture 14. Preferably, the spray head 16 is tubular in shape and also preferably is generally elongated. The spray head 16 also is preferably pivotally mounted in the housing 12. The preferred tubular shape of the spray head 16 is advantageous. This shape allows for increased water to be released and for better massaging action and comfort while bathing relative to known showerheads of the prior art. The tubular shaped spray head 16 preferably pivots about a longitudinal axis 18 aligned substantially or entirely vertically with the housing 12.

The showerhead assembly 10 has a control or control knob 20. The control knob 20 is disposed in an opening of the housing 14 in a lowermost region of the housing 12. The control knob 20 may alternatively be disposed in any suitable location on the housing 12 for easy and comfortable access. Preferably, the control knob 20 is an analog dial. However, the control knob 20 may be digital controller or be any other controller with any configuration known in the art. The control knob 20 is adjustable, preferably rotationally adjustable, to various settings including, for example, "on", "off" and "shower", to activate or deactivate the tubular shaped spray head 16 or to bypass the tubular shaped spray head and instead use a second showerhead (not shown).

The showerhead assembly 10 further has a movement control switch 22. The movement control switch 22 is disposed in a rectangular shaped slot in the housing 12 and is preferably disposed between the aperture 14 and the control knob 20. The movement control switch 22 preferably controls a spraying direction of the tubular shaped spray head 16. For example, when initially using the showerhead assembly 10, the bather may desire that the water be sprayed off to a lateral side, to test a temperature of the water. Accordingly, the bather may manipulate the movement control switch 22 in a clockwise or counterclockwise manner to rotate the tubular shaped spray head 16 to spray water away from the bather. Then, the bather may further manipulate the movement control switch 22 to spray the water on the bather for washing, when a desired temperature is achieved.

Figure 2:
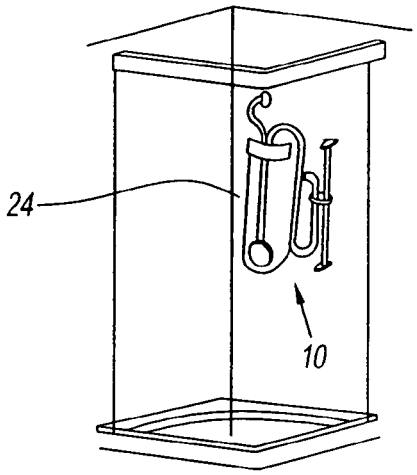
FIG. 2 is a partial, perspective view of the showerhead assembly mounted in a shower stall.

Referring to FIG. 2, there is shown the showerhead assembly 10 in a conventional standard shower stall 24. The showerhead assembly 10 is preferably removably mounted in the conventional standard shower stall 24 on, for example, a wall thereof where the bather may stand and bathe him or herself. Alternatively, the showerhead assembly 10 may be used in a swimming pool, a bathtub, a Jacuzzi, a footbath, a water basin or any other location where bathing or washing occurs.

Figure 2A:
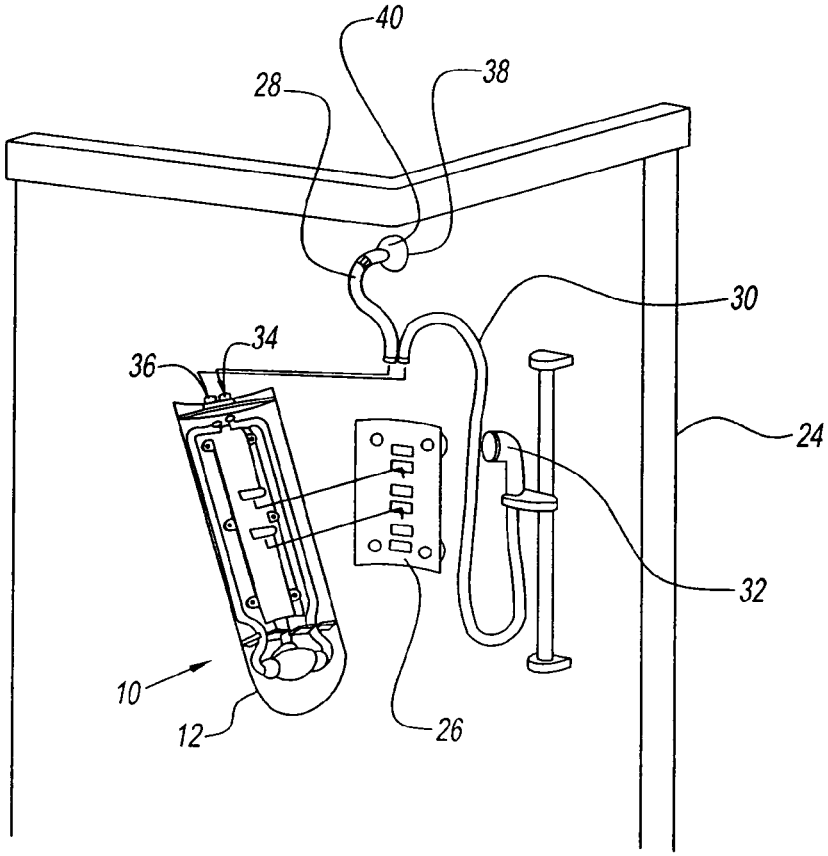
FIG. 2A is a rear view of the showerhead assembly being detached from the shower stall.

Referring to an exploded view of the rear of the showerhead assembly 10 shown in FIG. 2A, the showerhead assembly 10 has a mounting base 26. The mounting base 26 preferably is a support structure to mount the housing 12 on the shower stall 24. The mounting base 26 is preferably made from a suitable resilient material, however one skilled in the art should appreciate that the mounting base may be formed from a thermoplastic, a metal or any other suitable material known in the art. The mounting base 26 is preferably removably mounted to the shower stall 24 by a removable fastener, such as, for example, a desired number of suction cups. Alternatively, the mounting base 26 may be fixed to the shower stall 24 by mounting screws, nails, or any other mechanical fasteners that are known in the art.

Figure 3:
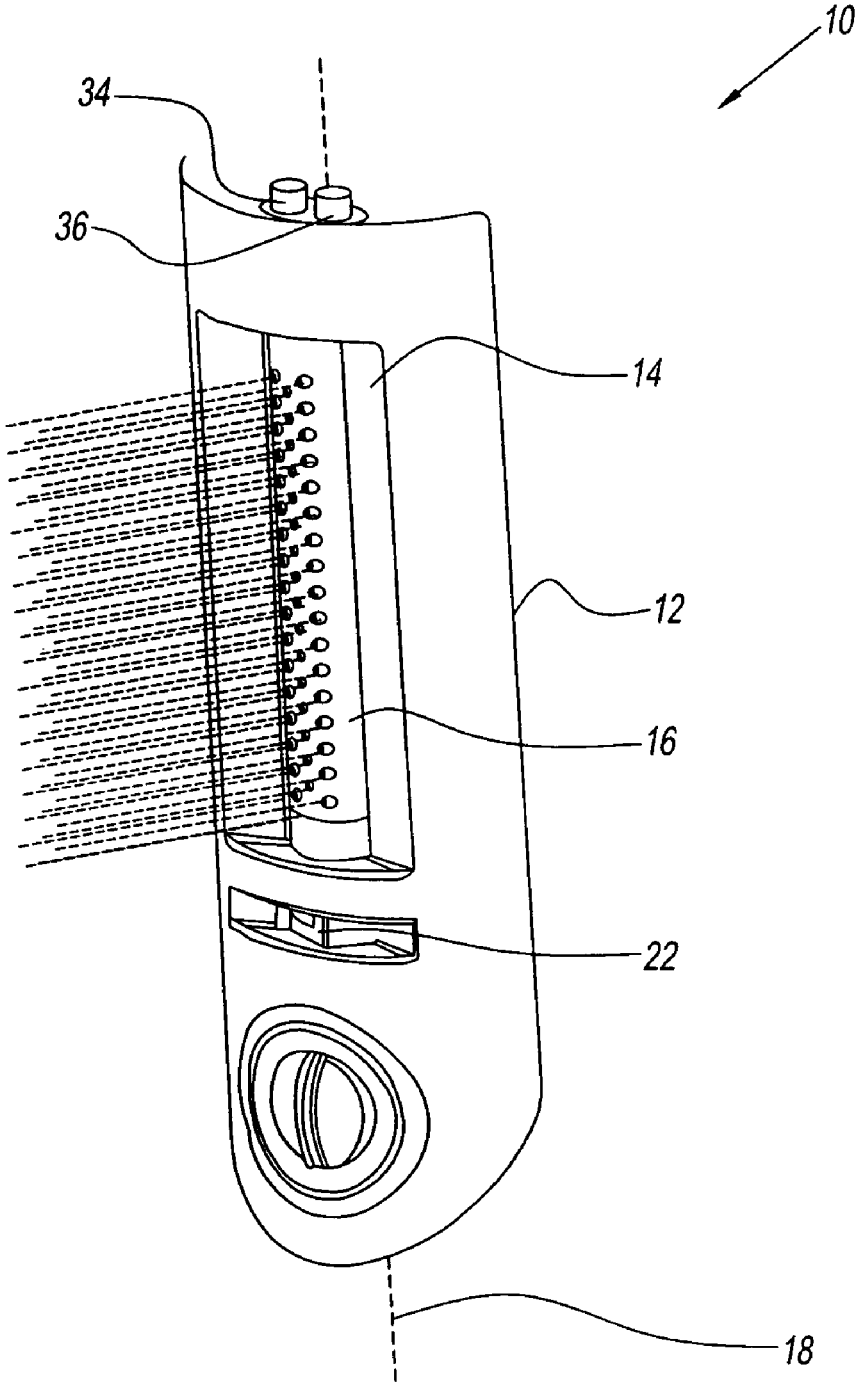
FIG. 3 is a perspective view of an exterior of the showerhead assembly emitting a number of water beams shown in dotted lines.

The showerhead assembly 10 has an intake hose 28 for supplying water from a water source 38 into the showerhead assembly. Preferably, the showerhead assembly 10 is fluidly connected to the water source by the intake hose 28. The showerhead assembly 10 also has an output structure, such as for example a hose 30 that leads from the showerhead assembly 10 to another second showerhead 32. The housing 12 may be mounted to the mounting base 26 by a number of hooks or any other mechanical fasteners that are known in the art. As shown in FIGS. 2A and 3, when fully assembled, the housing 12 and the mounting base 26 preferably enclose and protect the components of the showerhead assembly 10.

The showerhead assembly 10 has a water intake port 34 and a water output port 36. The water intake port 34 preferably communicates with the intake hose 28 and a water source 38. In this manner, water is supplied to the showerhead assembly 10. The water output port 36 carries water from the showerhead assembly 10 to the second showerhead 32.

Figure 4:
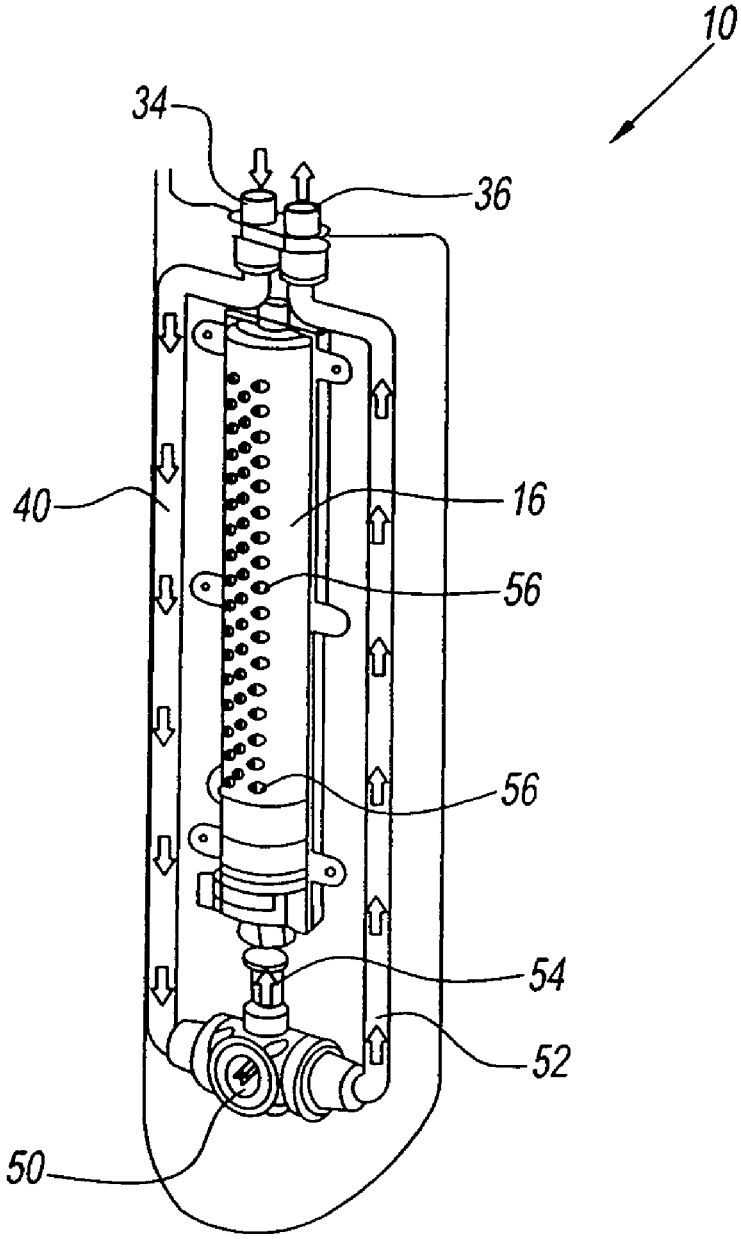
FIG. 4 is an interior perspective view of the showerhead assembly.

Referring to the front view of the showerhead assembly 10 with the housing 12 shown as transparent in FIG. 4, the showerhead assembly 10 has the water intake port 34 connected to a first tubular member 40 that is connected to a valve 50. The water output port 36 is connected to a second tubular member 52. The second tubular member 52 is further connected to the valve 50. The valve 50 of the showerhead assembly 10 is also connected to the tubular shaped spray head 16 by a third tubular member 54.

An amount of incoming water from the water source 38 is carried through the water intake port 34 to the valve 50. The valve 50 may have a ball valve (not shown) in the valve or similar device known in the art for selectively allowing the water access into the third tubular member 54, the tubular shaped spray head 16, or the second tubular member 52 and out of the water outlet port 36.

In this manner, the valve 50 may be set to a first condition to bypass to the second showerhead (not shown) by directing the water through the second tubular member 52 to the water output port 36, which is in fluid communication with the second showerhead. Alternatively, if the valve 50 is set to a second condition, water travels from the first tubular member 40 to the valve 50 to the third tubular member 54 and into the tubular shaped spray head 16. Once in the tubular shaped spray head 16, the water is directed through a number of spray apertures 56. Preferably, the water is output with a sufficient amount of pressure to cause a number of water beams to be emitted from each of the number of spray apertures 56. The control knob 20 being shown in FIG. 1, preferably selectively activates the valve 50 from the first condition to the second condition.

Figure 5:
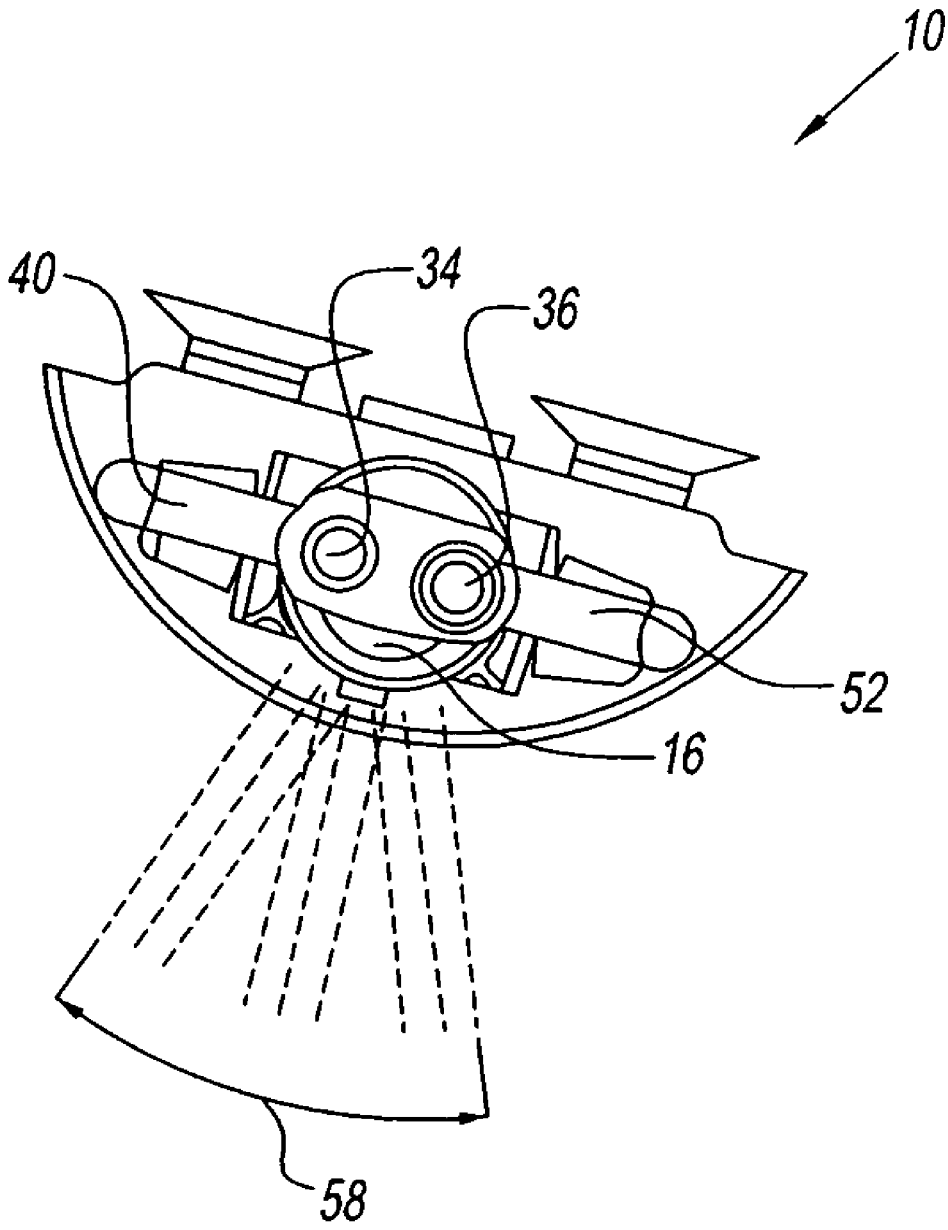
FIG. 5 is a top view of the showerhead assembly with emitted water beams shown in dotted lines.

Referring to FIG. 5, there is shown a top view of the showerhead assembly 10. As can be understood from the drawings, the water intake port 34 and the water output port 36 are both shown as detached or disconnected from the shower stall 24 and the water source 38. One of the significant aspects of the present invention is that the tubular shaped spray head 16 preferably rotates to provide a massaging action to the bather. The tubular shaped spray head 16 preferably outputs the number of water beams and rotates an amount generally designated as reference numeral 58. Preferably, this amount of rotation 58 of the tubular shaped spray head 16 is in a range that includes zero to sixty degrees. This rotation of the tubular shaped spray head 16 causes the number of water beams to rotate and sweep across a desired pattern. Adjusting the movement control switch 22 may selectively vary the pattern. The movement control switch 22 preferably increases or decreases the amount of rotation 58 of the tubular shaped spray head 16 and thus the pattern.

Figure 6:
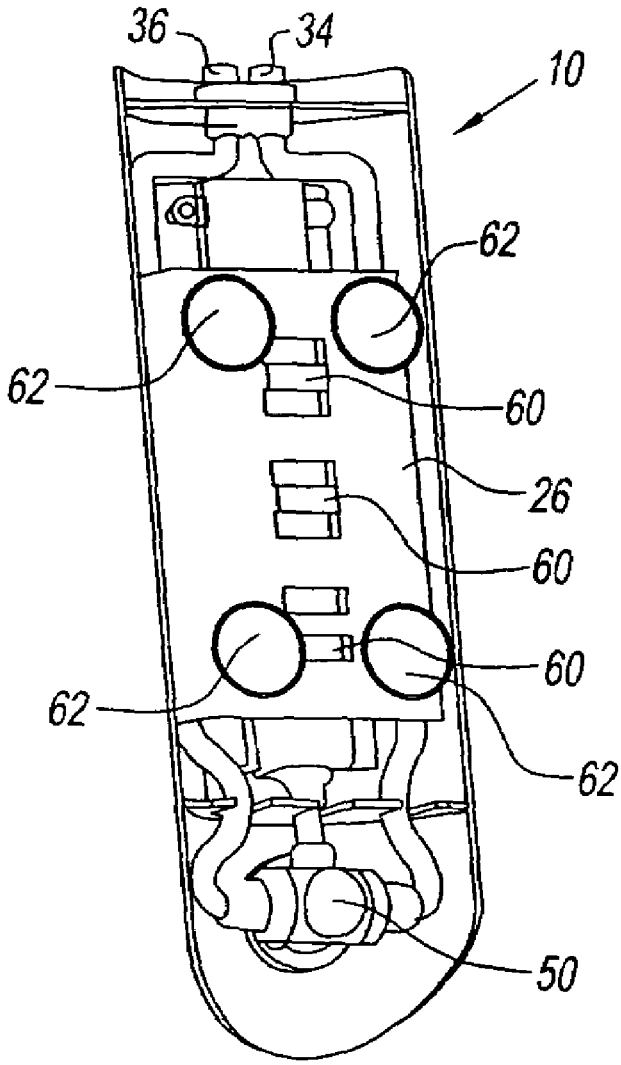
FIG. 6 is a rear view of the showerhead assembly with mounting plate and suction cups.

Referring to FIG. 6, which is a rear view of the showerhead assembly 10, the showerhead assembly has the mounting base 26 connected to the housing 12 by a number of clips 60. However, one skilled in the art should appreciate that the mounting base 26 may be connected to the housing 12 by any manner known in the art. The mounting base 26 preferably removably connects to the showerhead assembly 10 and to the shower stall 24. In this embodiment shown as FIG. 6, four suction cups 62 are disposed on the mounting base 26. Preferably, each of the four suction cups 62 holds a weight of the showerhead assembly 10 to removably mount the mounting base 26 and support the showerhead assembly on the shower stall 24. One skilled in the art should appreciate that any removable fasteners may be used in the art and is within the scope of the present invention.

Figure 7:
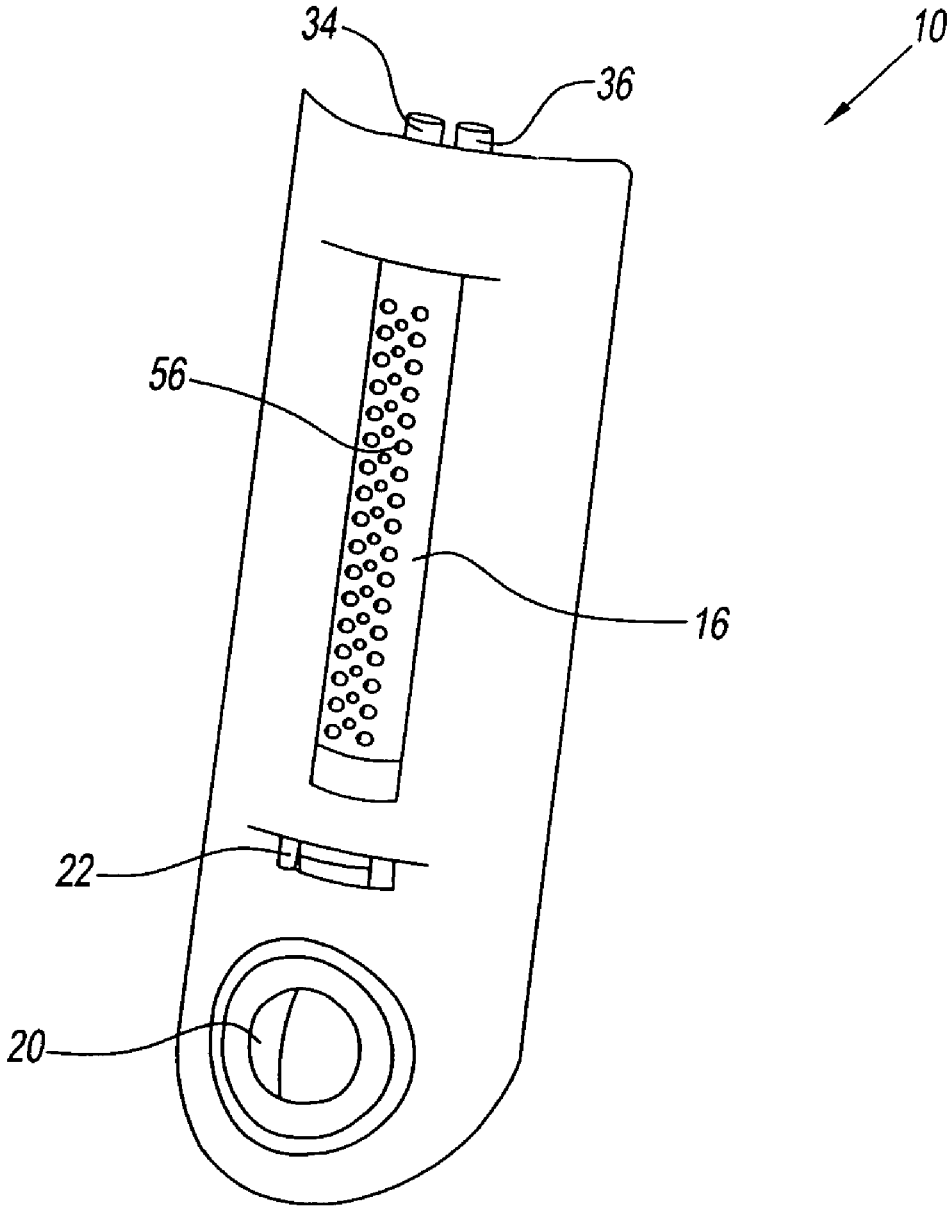
FIG. 7 is a front view of the showerhead assembly.

Referring to FIG. 7, there is shown another front view of the showerhead assembly 10. With reference to the tubular shaped spray head 16, the number of spray apertures 56 are disposed along a first side of the tubular shaped spray head. The spray apertures 56 are preferably disposed along a length of the tubular shaped spray head 16 in a number of rows that extend along the length. This is advantageous as it provides a spraying action along a greater surface area of the bather and, thus, provides more massaging action. In this embodiment, three rows are shown. However, one skilled in the art should appreciate that any number of rows may be used and is within the scope of the present invention. Each row has about seventeen spray apertures. However, one skilled in the art should appreciate that any number of spray apertures may be used with the showerhead assembly 10 and any configuration may be used, such as, for example, a circular pattern of the number of spray apertures.

Figure 8:
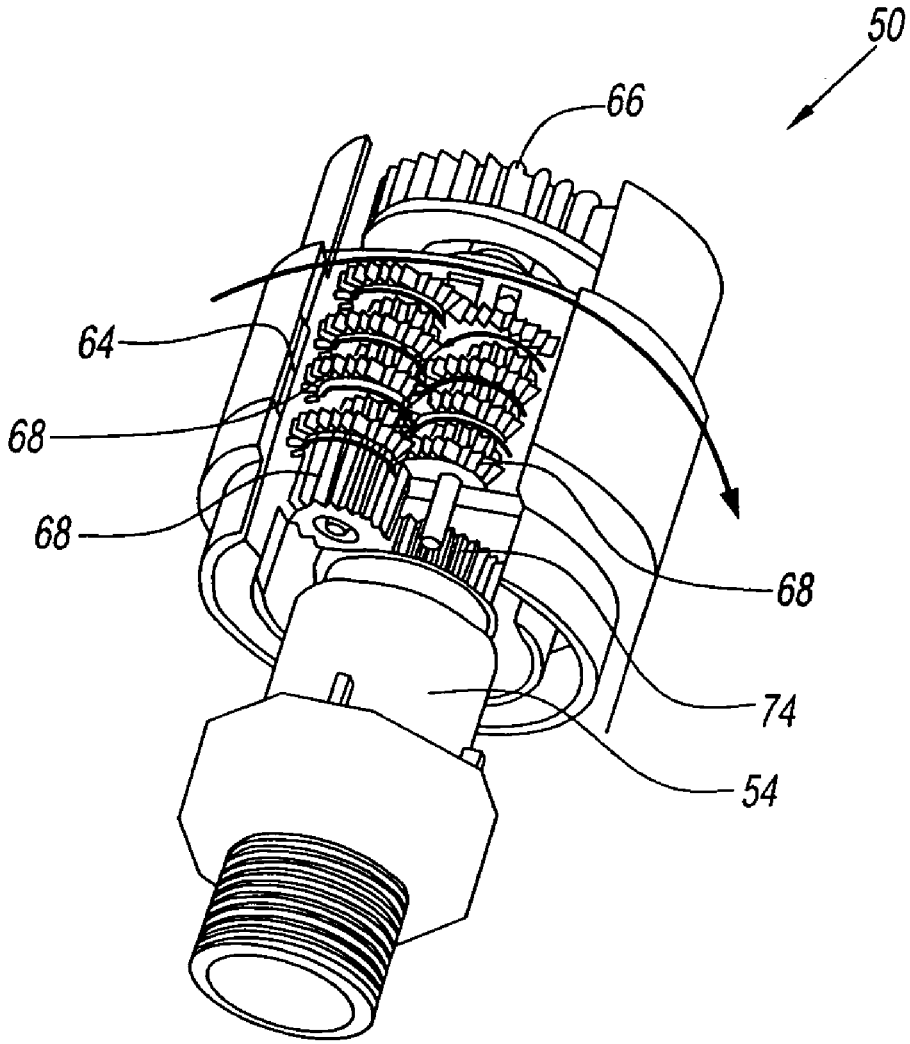
FIG. 8 is an interior perspective view of a gearbox in a valve of the showerhead assembly.

Another exemplary aspect of the showerhead assembly is that the rotation of the tubular spray head 16 is powered by water traversing through the valve 50. Referring to FIG. 8, there is shown an interior perspective view of the valve 50 of the showerhead assembly 10. The valve 50 is connected to the third tubular member 54, which is shown as disconnected from the tubular shaped spray head 16. Disposed in the valve 50 is a gear box 64. The gear box 64 is preferably a watertight enclosure suitable to retain a number of gears and axles therein. Disposed in the gear box 64 is a first gear 66 and a gear assembly 68.

Figure 9:
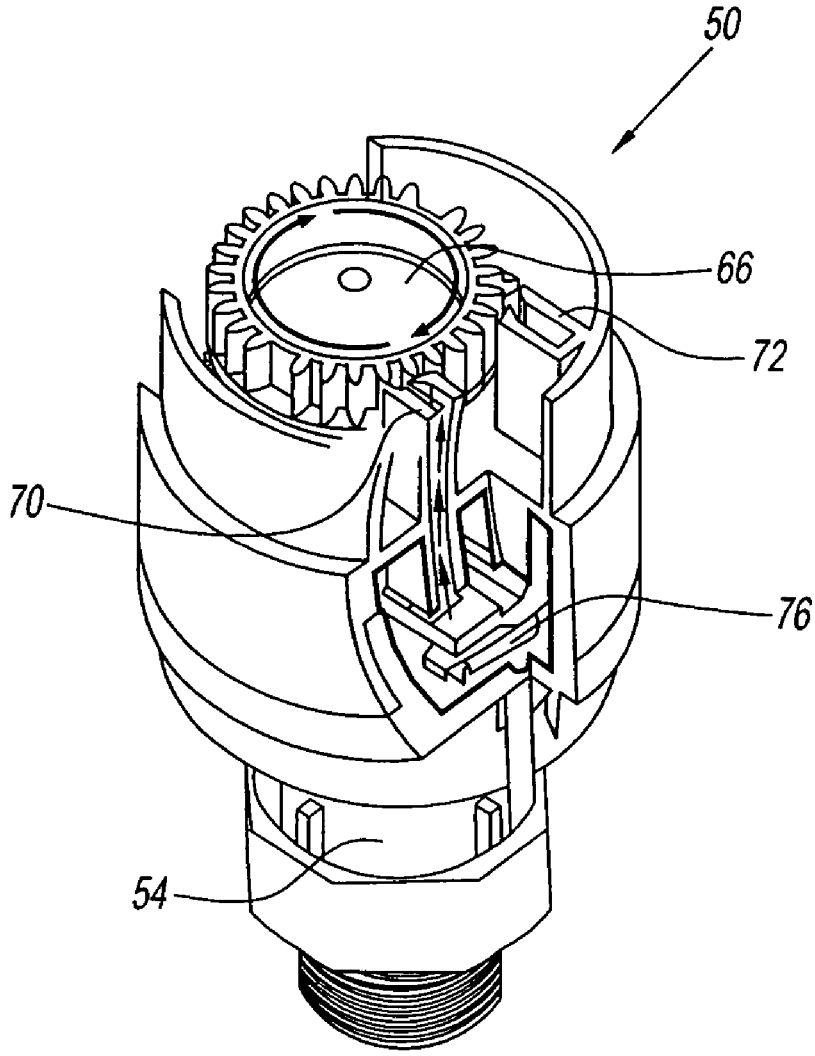
FIG. 9 is another interior view of the valve of FIG. 8 with a first and second fluid channel.

The specific gear arrangement of the gear assembly 68 and the first gear 66 for converting the water flow into energy to rotate the tubular shaped spray head 16 may be selected from a variety of arrangements known to those skilled in the art. In a preferred embodiment being shown in FIG. 8, the first tubular member 40, shown in FIG. 4, preferably delivers water to the valve 50. In the valve 50, the water contacts the first gear 66. The water contacts the first gear 66 by escaping a first fluid channel 70 or a second fluid channel 72 being shown in FIG. 9, that are both disposed in spaced relation from the first gear 66. Preferably, the valve 50 has the first fluid channel 70 and the second fluid channel 72 to deliver water from the first tubular member 40 to a number of teeth of the first gear 66. Once the water contacts the teeth of the first gear 66, the water pushes the first gear and rotates the first gear.

Referring again to FIG. 9, there is shown a top partially cross-sectional view of the valve 50. The valve 50 preferably has two fluid channels, the first second fluid channel 70 and the second fluid channel 72. However, one should appreciate that the valve 50 may be formed with any number of fluid channels known in the art. The first fluid channel 70 and the second fluid channel 72 are preferably formed as integral slots with a housing of the valve 50 and may be formed as the same materials as the valve. Preferably, the first and second fluid channels 70, 72 are each generally orthogonal shaped. However, the first and the second fluid channels 70, 72 may have any shape or size known in the art to direct water from the water source 38, shown in FIG. 2A, traversing through the showerhead assembly 10 and direct the water on to the first gear 66.

As water passes through one of the first and second fluid channels 70, 72, the water causes the first gear 66 to rotate in a first direction. The first gear 66 engages and rotates the gear assembly 68. Preferably, the gear assembly 68 and engages a fixed gear 74 shown in FIG. 8 that is fixed relative to the third tubular member 56, and is fixed relative to the housing 12 and shower stall 24. When the gear assembly 68 rotates and engages the fixed gear 74, the fixed gear rotates the tubular shaped spray head 16. This causes the tubular shaped spray head 16 to rotate in the pattern.

Figure 10:
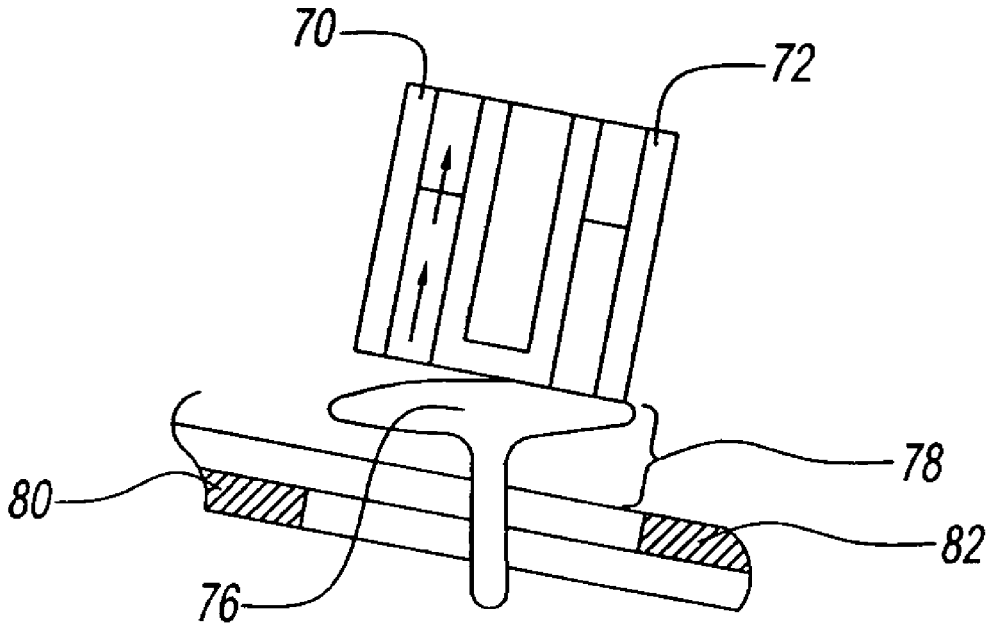
FIG. 10 is another top view of the interior of the valve with the first and the second fluid channels and a rod of FIG. 9.

The rotation of the tubular shaped spray head 16 may be selectively changed from a clockwise rotation to a counterclockwise rotation upon actuation of the movement control switch 22 as shown. The movement control switch 22 is preferably connected to a rod 76, shown in FIG. 10, disposed through the valve 50 in a watertight manner. The rod 76 has a backing and preferably forms a substantially "T" shaped member, however one skilled in the art should appreciate that the rod 76 may have any configuration known in the art. The rod 76 selectively covers one of the first and the second fluid channels 70, 72. In this manner, water has access to the first fluid channel 70 or the second fluid channel 72. The rod 76 selectively allows water to contact the first gear 66 to move the first gear clockwise or counterclockwise. This contact causes the first gear 66 to rotate in the clockwise manner or a counter clockwise manner, thereby changing the rotation of the tubular shaped spray head 16.

The rod 76 when actuated in a left to right fashion as shown selectively allows water to access the first fluid channel 70 and simultaneously closes the second fluid channel 72. This permits the water to enter the first fluid channel 70 and thereby contact the first gear 66 causing rotation in a clockwise manner. Conversely, when the rod 76 is actuated, in reverse or in a right to left direction, the rod permits access to the second fluid channel 72 and close the first fluid channel 70. This permits water to enter the second fluid channel 72 and thereby cause rotation of the first gear 66 in the counterclockwise manner. The process repeats itself as a steady flow of pressurized water is provided, thereby causing the rotation of the tubular shaped spray head 16 while emitting the arcuate pattern of water beams. One skilled in the art should appreciate that the valve 50 has a gap 78 between the first and second fluid channels 70, 72. The gap 78 is sized to permit the rod 76 to traverse as shown.

Figure 11:
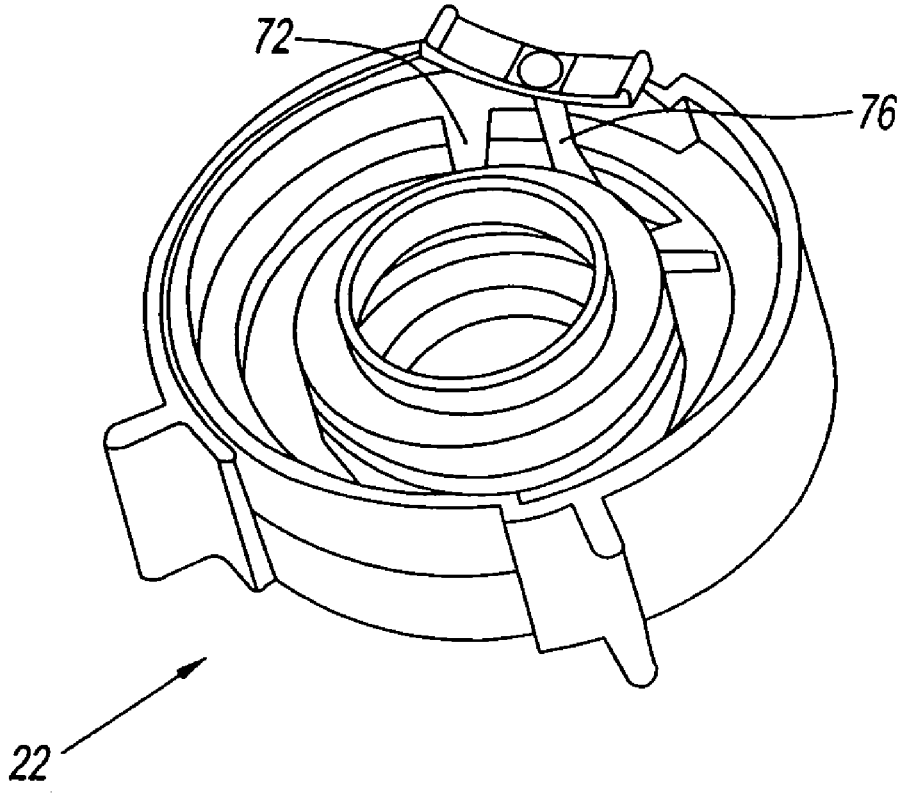
FIG. 11 is an interior perspective view of the movement control switch connected to the rod.

Referring to FIG. 11, there is shown a perspective view of the movement control switch 22 connected to the rod 76. The movement control switch 22 preferably has a handle portion for grasping and actuating the movement control switch in a clockwise or counter clockwise direction. Preferably, this actuation of the movement control switch 22 blocks one of the first channel 70 or the second channel 72. Alternatively, the rod 76 may be a pivot valve connected to movement control switch 22 as shown in FIG. 11. The pivot valve may traverse in a rotational manner to selectively open or close either the first or second channel 70, 72.

Figure 12:
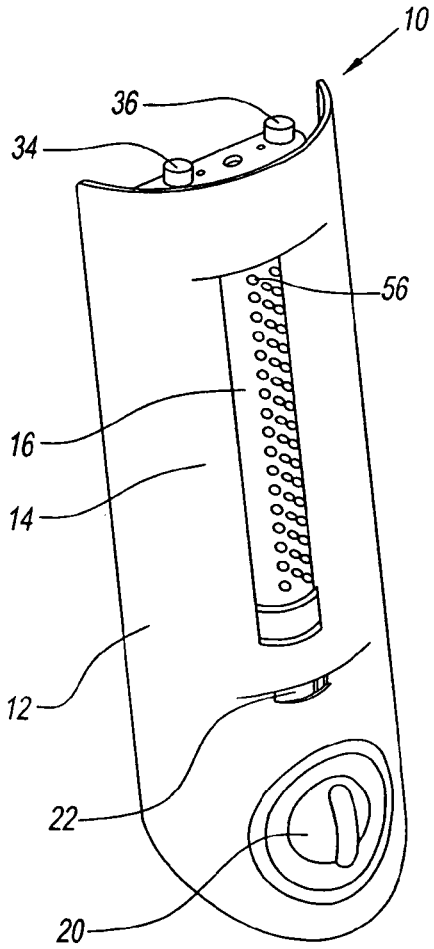
FIG. 12 is a front perspective view of another embodiment of the showerhead assembly of FIG. 1.
Figure 12A:
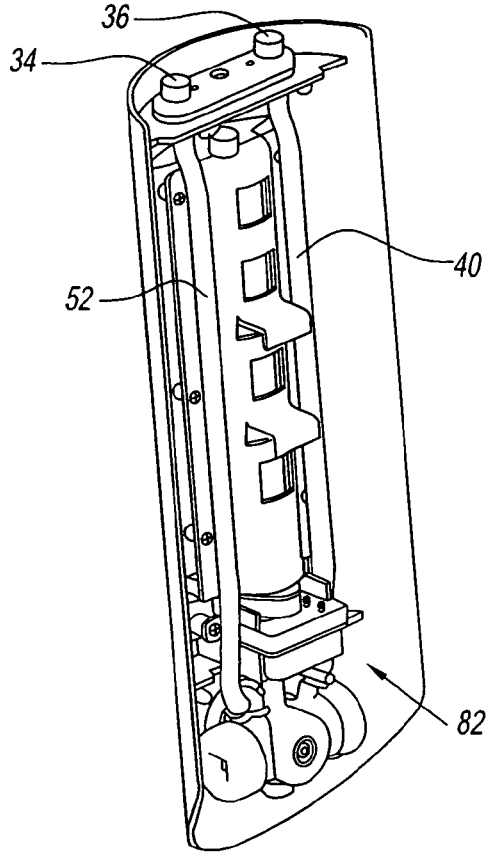
FIG. 12A is a rear perspective view of the showerhead assembly of FIG. 12.

In another alternative embodiment of the present invention, there is shown the showerhead assembly 10 as shown in FIGS. 12 and 12A. Referring to a rear of the showerhead assembly 10, being shown in FIG. 12A, the showerhead assembly has a direction selection apparatus generally represented by reference numeral 82. The direction selection apparatus 82 is preferably disposed in a bottommost portion of the showerhead assembly 10. Preferably, the direction selection apparatus 82 controls the pattern of rotation of the tubular shaped spray head 16 of the showerhead assembly 10 and provides improved massaging action to the user.

Figure 13:
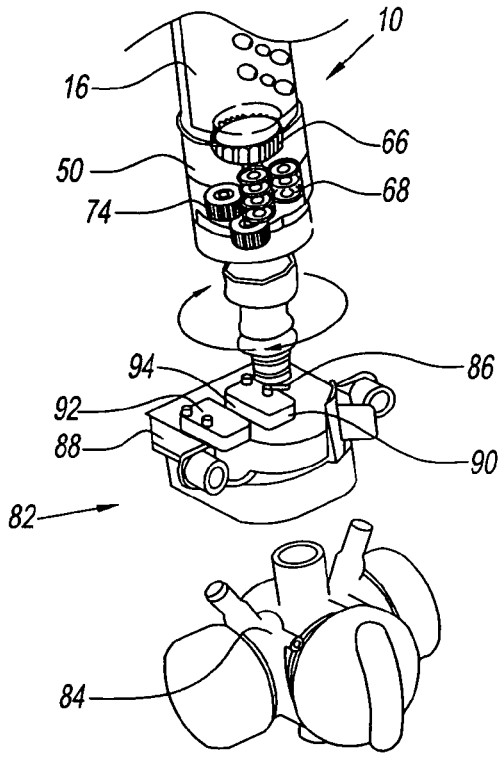
FIG. 13 is a front exploded view of the showerhead assembly of FIG. 12.
Figure 13A:
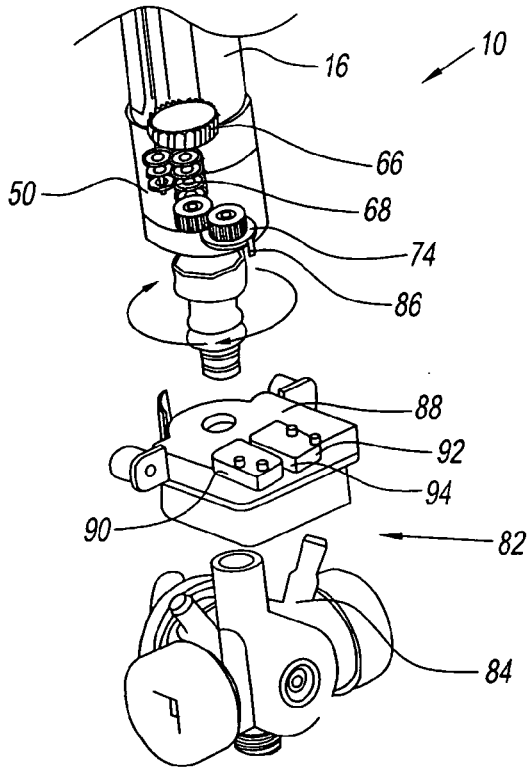
FIG. 13A is a rear exploded view of the showerhead assembly of FIG. 12A.

Referring to FIGS. 13 and 13A, there is shown a front and a rear exploded view of the showerhead assembly 10. The direction selection apparatus 82 has a second valve 84 connected to a water source (not shown). The second valve 84 is connected to the third tubular member 54 to drive the first gear 66. The first gear 66 drives the gear assembly 68 in the valve 50.

In this embodiment, the showerhead assembly 10 has the fixed gear 74 connected to an arm 86. The arm 86 is a longitudinally shaped member made from a resilient material that extends substantially perpendicular, and preferably perpendicular, from the longitudinal axis 18 of the showerhead assembly 10.

The direction selection apparatus 82 further has a plate 88. The plate 88 is preferably on a bottom of the showerhead assembly 10 and has a planar surface in spaced relation to the arm 86. The plate 88 has a first end plate 90 and a second end plate 92 disposed thereon. The first end plate 90 and the second end plate 92 are preferably two orthogonal shaped members both having a height to define a gap 94. The gap 94 is disposed between the first and the second end plates 90, 92. Preferably, the arm 86 fits into the gap 94 between the first and the second end plates 90, 92 such that the arm can intermittently contact the first and the second end plates when rotating.

Preferably, the arm 86 is powered by the rotation of the first gear 66 caused by the water traversing thereon. The arm 86 rotates in the gap 94. In this manner, the arm 86 contacts the first and second end plates 90, 92 such that the reaction force will cause the arm to rotate the tubular shaped spray head 16 relative to the housing 12.

Figure 14:
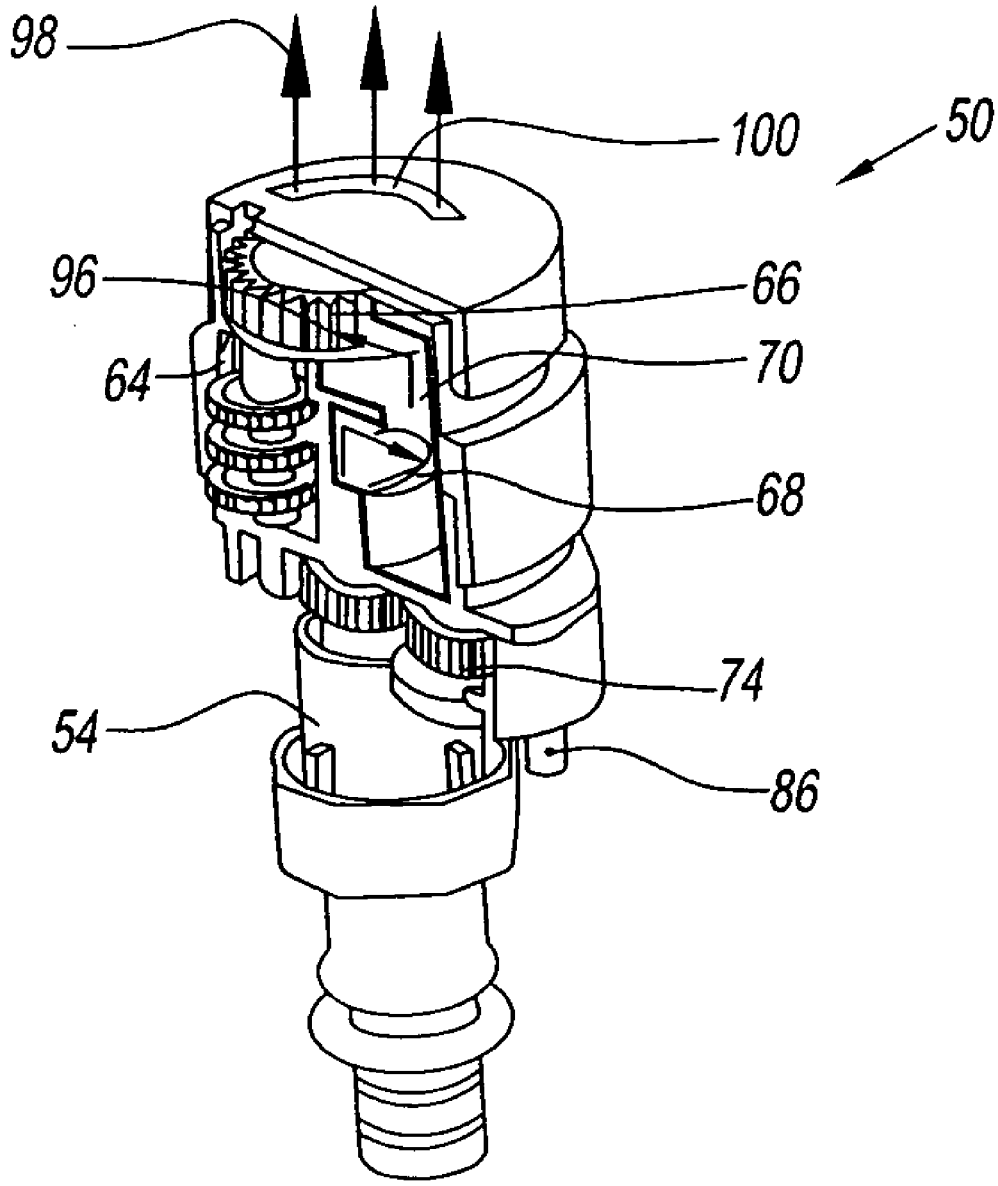
FIG. 14 is a cross sectional view of the valve of the showerhead assembly of FIG. 13.

As shown in FIG. 14, there is shown a cross-sectional view of the valve 50. Water traverses through the third tubular member 54 and into the valve 50. As water passes through and enters the valve 50 from the second valve 84, the water enters the gearbox 64. The water escapes out of the first fluid channel 70 and rotates the first gear 66 marked by an arrow 96 for illustration purposes. As the water exits as shown by arrows 98, the water drives the first gear 66. The water passes out of an opening 100 of the valve 50 to the tubular shaped spray head 16. Contemporaneously, the gear assembly 68 rotates in response to the rotation of the first gear 66 and thereby turns the arm 86.

Figure 15:
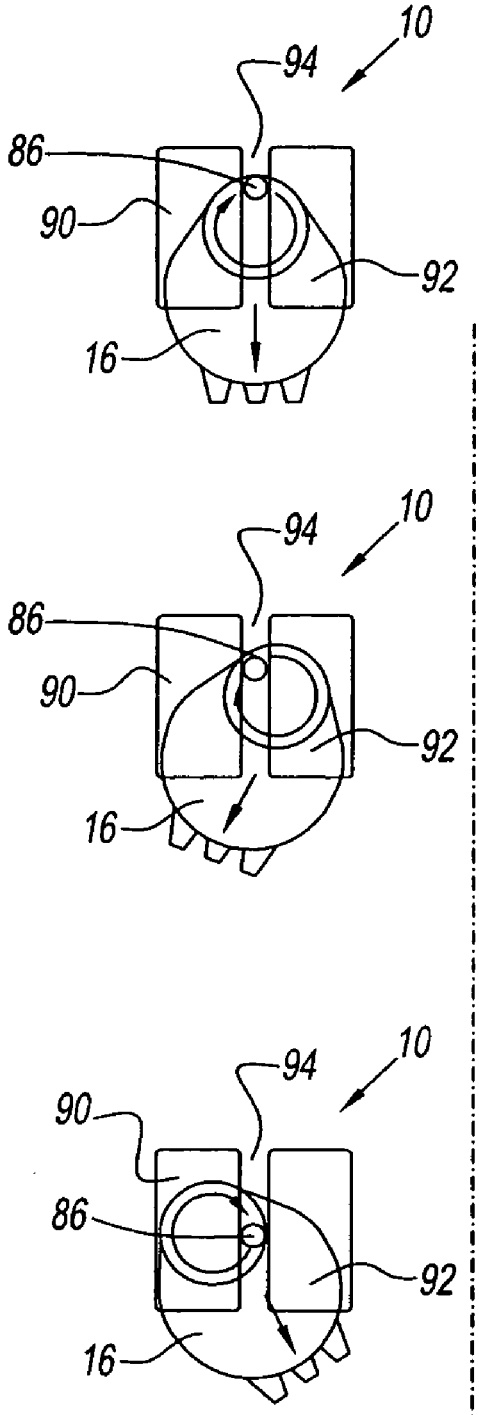
FIG. 15 is a top view of the tubular shaped spray head with a portion of the spray head in a first position.

The pattern of rotation of the tubular shaped spray head 16 is achieved by the arm 86 and direction selection apparatus 82 and is illustrated in FIGS. 15 and 15A. The arm 86 is between the first end plate 90 and a second end plate 92 with the first end plate and the second end plate defining the gap 94, and with the arm shown in first, second and third rotating positions. As shown by the figures, the arm 86 contacts the first end plate 90 and second end plate 92 located on the plate 88, while the arm rotates in the gap 94 formed therein. In this manner, the tubular shaped spray head 16 rotates in response thereto.

The rotation of the tubular shaped spray head 16 can be selectively varied. The direction selective apparatus 82 varies the rotation. Referring to FIG. 15, the gap 94 is relatively small in this embodiment. This causes the tubular shaped spray head 16 to rotate in a range that includes zero to about sixty degrees range relative to the longitudinal axis 18.

Figure 16:
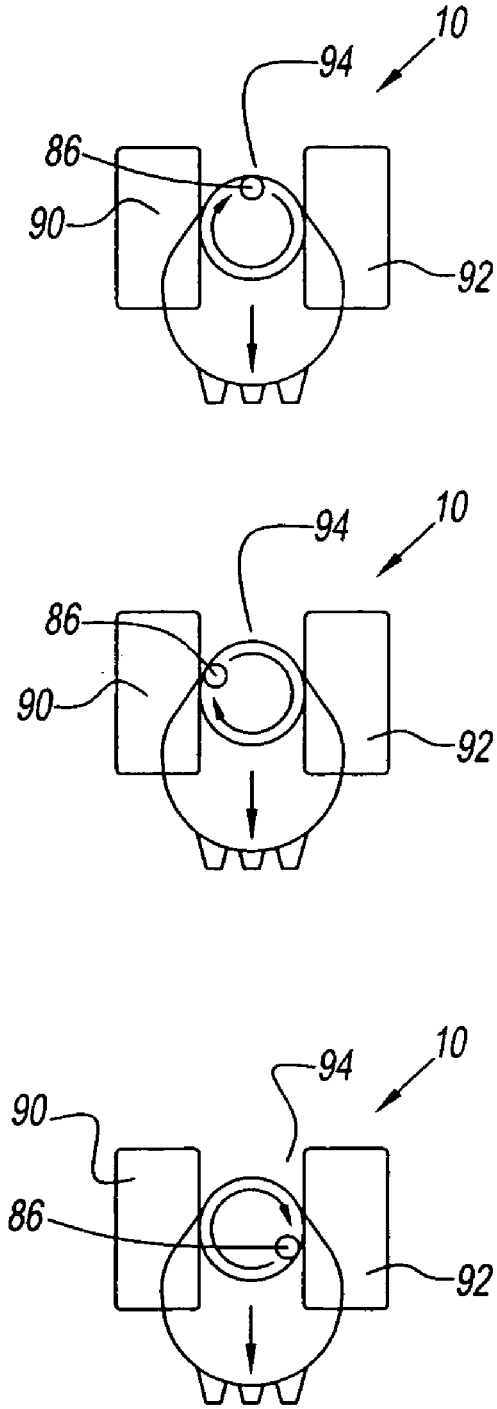
FIG. 16 is a second top view of the tubular shaped spray head with a portion of the head in a second position.

FIG. 16 shows the arm 86 being between the first end plate 90 and the second end plate 92 with the first end plate and the second end plate defining a second sized gap 94 being wider than the first gap of FIG. 15, and again with the arm shown in a first, second and third rotating position. Referring to the embodiment shown in FIG. 16, the rotation of the tubular shaped spray head 16 is less than the zero or about sixty degrees range and the tubular shaped spray head remains virtually stationary. This is accomplished by increasing a length of the gap 94 or the distance between the first end plate 90 and the second end plate 92 on the plate 88. When the length of the gap 94 or distance between the first and the second end plates 90, 92 is relatively smaller, the range of motion of the arm 86 is arcuate as shown. When the length of the gap 94 is relatively larger, the range of motion of the arm is limited and the tubular shaped spray head 16 is stationary, as also shown.

If the first and second end plates 90, 92 are moved apart so that the arm 86 cannot contact the first and second end plates, the tubular shaped spray head 16 will not rotate and stays in a static position.

Figure 17:
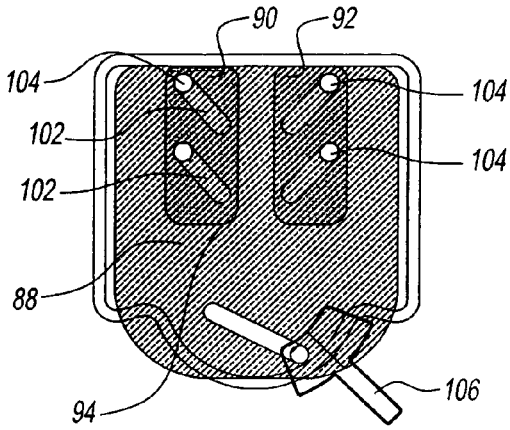
FIG. 17 is a top view of a plate having the first and the second end plates thereon.
Figure 18:
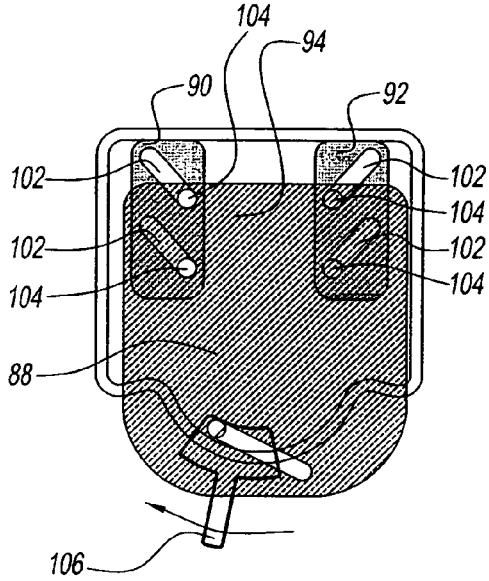
FIG. 18 is a top view of the plate of FIG. 17 with the first and the second end plates being in a different position.

Referring to FIGS. 17 and 18, an exemplary feature of the present invention is that the first and the second end plates 90, 92 are movable in a lateral fashion relative to one another. In this manner, the gap 94 is selectively adjustable. Referring to FIG. 17, there is shown a top view of the plate 88 having the first and second end plates 90, 92 disposed thereon. Each end plate 90, 92 is formed with at least one slot 102 and at least one pin 104 disposed in the one slot.

The plate 88 has a handle 106 disposed at an end thereof. Referring to FIG. 16, there is shown a view of the first end plate 90 and the second end plate 92 having the gap 94 disposed therebetween. The gap 94 has a desired length such that upon rotation of the arm 86 the tubular shaped spray headhead assembly 16 will rotate in a range that includes zero to sixty degrees.

Referring to FIG. 18, there is shown the plate 88 in a second alternative position. If the bather desires that the tubular shaped spray head 16 be stationary, the bather actuates the handle 106. The handle 106 moves the plate 88 and forces each pin 104 to traverse in its respective slot 102 to selectively change the length of the gap 94. This limits the contact of the arm 86 on either the first end plate 90 or the second end plate 92 and thereby reduces the rotation of the tubular shaped spray head 16.

Figure 19:
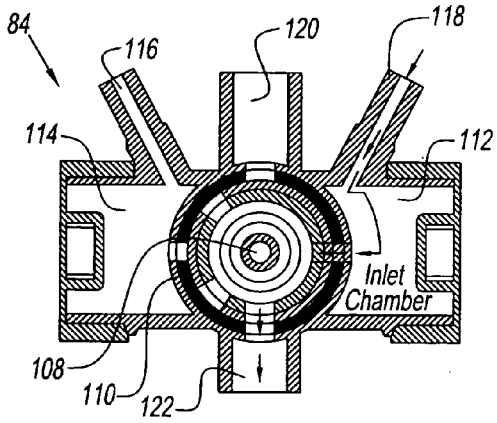
FIG. 19 is a schematic, side sectional view of a second valve of the showerhead assembly of FIG. 13A showing a first setting.

Referring to FIGS. 19 through 22, there is shown a cross-sectional view of the second valve 84 in four settings. Referring to FIG. 19, the second valve 84 has a knob 108, a member 110, a first chamber 112 and a second chamber 114. The knob 108 preferably moves the member 110 in the second valve 84 to a number of settings. The second valve 84 has a first output port 116, an inlet port 118, a second output port 120, and a third output port 122.

The knob 108 preferably moves the member 110 to selectively block a desired port and allow water to selectively access and be output to another port. In FIG. 19, the member 110 allows water to traverse from inlet port 118 to the third output port 122 to, for example, a third showerhead (not shown).

Figure 20:
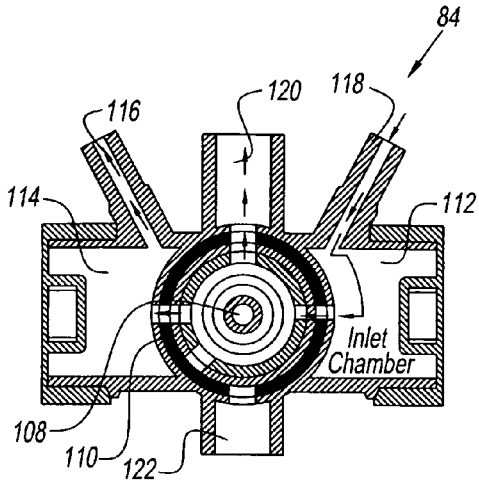
FIG. 20 is another schematic, side sectional view of a second valve of the showerhead assembly of FIG. 13A showing a second setting.
Figure 21:
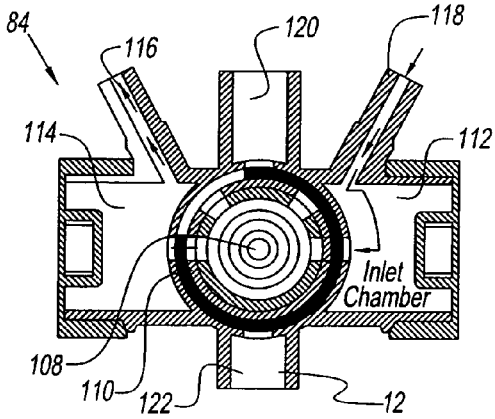
FIG. 21 is a schematic, top sectional view of a second valve of the showerhead assembly of FIG. 13A showing a third setting.
Figure 22:
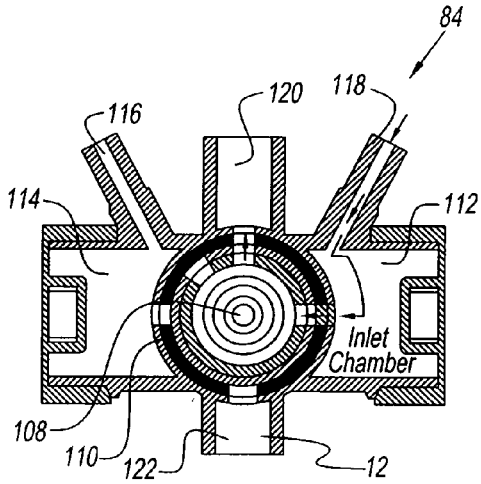
FIG. 22 is a schematic, top sectional view of a second valve of the showerhead assembly of FIG. 13A showing a fourth setting.

Referring to FIG. 20, the member 110 allows water to traverse from the inlet port 118 to the first output port 116 that is connected to the second showerhead 32 shown in FIG. 2A. In FIG. 21, the member 110 allows water to traverse and collect from the inlet port 118 to the first chamber 112 and terminate operation of the showerhead assembly 10. In FIG. 22, the member 110 allows water to traverse from the inlet port 118 to the second output port 120 connected to the tubular shaped spray head 16.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A showerhead assembly comprising:

a tubular shaped spray head having a longitudinal axis, said tubular shaped spray head having a plurality of apertures being located along said longitudinal axis, said tubular shaped spray head being connected to a water source for introducing water in said tubular shaped spray head;

a housing for supporting said tubular shaped spray head on a surface, wherein said water traverses through said tubular shaped spray head for spraying a plurality of beams of water through said plurality of apertures;

a transmission, said transmission being in a path of said water flowing from said water source to said tubular shaped spray head, wherein said water actuates said transmission, said transmission rotating said tubular shaped spray head through an arcuate path; and an input port and an output port, said input port being connected to said water source and to said tubular shaped spray head, said output port being connected to said tubular shaped spray head, said output port being connected to a second spray head, wherein said transmission is between said input port and said output port to receive said water.

2. The showerhead assembly of claim 1, wherein said tubular shaped spray head is aligned with an opening in said housing to allow said plurality of beams of water to traverse through said opening.

3. A showerhead assembly comprising:

a tubular shaped spray head having a longitudinal axis, said tubular shaped spray head having a plurality of apertures being located along said longitudinal axis, said tubular shaped spray head being connected to a water source for introducing water in said tubular shaped spray head;

a housing for supporting said tubular shaped spray head on a surface, wherein said water traverses through said tubular shaped spray head for spraying a plurality of beams of water through said plurality of apertures;

a transmission, said transmission being in a path of said water flowing from said water source to said tubular shaped spray head, wherein said water actuates said transmission, said transmission rotating said tubular shaped spray head through an arcuate path, wherein said transmission is in a valve, said valve being connected between said tubular shaped spray head and said water source;

a fixed gear, said fixed gear being connected to a plurality of second gears in said valve at a first position on said valve, said first position being opposite said tubular shaped spray head, said plurality of second gears rotating said fixed gear, said fixed gear rotating said tubular shaped spray head.

4. The showerhead assembly of claim 3, wherein said first gear and said plurality of second gears are disposed in a gear box in said valve.

5. The showerhead assembly of claim 4, further comprising a first plate with a first slot and a second plate with a second slot, said housing having a plurality of pins, said plurality of pins traversing through each of said first slot and said second slot, said first plate and said second plate being movable on said plurality of pins for selectively changing a distance of a gap being between said first plate and said second plate.

6. The showerhead assembly of claim 3, wherein said tubular shaped spray head is aligned with an opening in said housing to allow said plurality of beams of water to traverse through said opening.

7. A showerhead assembly comprising:

a tubular shaped spray head having a longitudinal axis, said tubular shaped spray head having a plurality of apertures being located along said longitudinal axis, said tubular shaped spray head being connected to a water source for introducing water in said tubular shaped spray head;

a housing for supporting said tubular shaped spray head on a surface, wherein said water traverses through said tubular shaped spray head for spraying a plurality of beams of water through said plurality of apertures; and a transmission, said transmission being in a path of said water flowing from said water source to said tubular shaped spray head, wherein said water actuates said transmission, said transmission rotating said tubular shaped spray head through an arcuate path, wherein said transmission comprises a first gear and a plurality of second gears, said first gear being rotated by said water, said first gear rotating said plurality of second gears in response thereto, and wherein said valve has an interior space, said valve having a plurality of fluid channels, said plurality of fluid channels being arranged such that said water traverses out of at least one of said plurality of fluid channels and contacts a radial position of said first gear, said water rotating said first gear.

8. The showerhead assembly of claim 7, further comprising an arm, said arm being connected to said plurality of second gears in said valve at a first position on said valve, said first position being opposite said tubular shaped spray head, said plurality of second gears rotating said arm.

9. The showerhead assembly of claim 7, further comprising a pivotable valve, said pivotable valve being connected to a switch, said pivotable valve selectively closing at least one of said plurality of fluid channels and selectively opening at least one of a reminder of said plurality of fluid channels upon actuation of said switch so that said water traverses out of said plurality of fluid channels and selectively rotates said first gear in a direction, said direction being selected from the group consisting of a clockwise direction, a counterclockwise direction, and any combination thereof.

10. The showerhead assembly of claim 7, wherein said tubular shaped spray head is aligned with an opening in said housing to allow said plurality of beams of water to traverse through said opening.

11. A showerhead assembly comprising:

a tubular shaped spray head having a longitudinal axis, said tubular shaped spray head having a plurality of apertures being located along said longitudinal axis, said tubular shaped spray head being connected to a water source for introducing water in said tubular shaped spray head; and a housing for supporting said tubular shaped spray head on a surface, wherein said water traverses through said tubular shaped spray head for spraying a plurality of beams of water through said plurality of apertures, wherein said housing has a first plate and a second plate, each of said first plate and said second plate having a height, said second plate being disposed adjacent to said first plate to define a gap being therebetween.

12. The showerhead assembly of claim 11, further comprising an arm being disposed in said gap.

13. The showerhead assembly of claim 12, further comprising a plurality of second gears for rotating said arm so that said arm contacts said first plate, said arm rotating said tubular shaped spray head through an arcuate path.

14. The showerhead assembly of claim 13, wherein said arcuate path is in a range of rotation that includes zero degrees to about sixty degrees.

15. A showerhead assembly comprising:

a tubular shaped spray head having a longitudinal axis, said tubular shaped spray head having a plurality of apertures being located along said longitudinal axis, said tubular shaped spray head being connected to a water source for introducing water in said tubular shaped spray head; and a housing for supporting said tubular shaped spray head on a surface, wherein said water traverses through said tubular shaped spray head for spraying a plurality of beams of water through said plurality of apertures, wherein said plurality of water beams exit said plurality of apertures in a manner selected from the group consisting of a pulsating manner, a continuous manner, and any combination thereof.

16. A showerhead assembly comprising:

a tubular shaped spray head having a longitudinal axis, said tubular shaped spray head having a plurality of apertures being located along said longitudinal axis, said tubular shaped spray head being connected to a water source for introducing water in said tubular shaped spray head; and a housing for supporting said tubular shaped spray head on a surface, wherein said water traverses through said tubular shaped spray head for spraying a plurality of beams of water through said plurality of apertures, wherein said housing is removably connected to said surface.

17. A showerhead assembly comprising:

a spray head having a longitudinal axis and a first surface disposed along said longitudinal axis, said spray head having a plurality of apertures being disposed in a plurality of rows on said first surface, said spray head being connected to a source for introducing fluid to said spray head;

a housing having an aperture, said housing having a first side and a second side, said second side having a member for supporting said housing on a surface, said water traversing through said spray head for spraying a plurality of beams of water through said plurality of apertures;

a rotation device for rotating said spray head, said spray head rotating in a range that includes about zero to about sixty degrees; and a plate with a handle, said plate having a first end plate and a second end plate on said plate, said first end plate and said second end plate each having a slot, and a pin in said slot, wherein said rotation device rotates an arm being between said first end plate and said second end plate, and wherein said handle traverses said plate to selectively adjust a distance between said first end plate and said second end plate to selectively change said range.

18. The showerhead assembly of claim 17, wherein said rotating device is actuated by said fluid being introduced in said spray head from said source.

* * * * *